US008297097B2

(12) United States Patent
Mishima

(10) Patent No.: US 8,297,097 B2
(45) Date of Patent: Oct. 30, 2012

(54) CLOSING METHOD AND CLOSING MACHINE

(75) Inventor: Keisuke Mishima, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 615 days.

(21) Appl. No.: 11/887,271

(22) PCT Filed: Mar. 30, 2006

(86) PCT No.: PCT/JP2006/307270

§ 371 (c)(1),
(2), (4) Date: Sep. 27, 2007

(87) PCT Pub. No.: WO2006/107091

PCT Pub. Date: Oct. 12, 2006

(65) Prior Publication Data

US 2009/0139292 A1 Jun. 4, 2009

(30) Foreign Application Priority Data

Mar. 31, 2005 (JP) ..... 2005-101814

(51) Int. Cl.
*B21D 22/16* (2006.01)
*B21D 3/00* (2006.01)

(52) U.S. Cl. ..... 72/82; 72/84; 72/112; 72/115

(58) Field of Classification Search ..... 72/84, 85, 72/112, 115, 125, 370.1, 370.12, 80, 82
See application file for complete search history.

(56) References Cited

U.S. PATENT DOCUMENTS

| | | | | |
|---|---|---|---|---|
| 3,910,423 | A * | 10/1975 | Killian et al. | 414/591 |
| 6,381,843 | B1 * | 5/2002 | Irie et al. | 29/890 |
| 7,022,922 | B2 | 4/2006 | Nowakowski | |
| 2003/0154600 | A1 | 8/2003 | Umeda et al. | |
| 2004/0045778 | A1 | 3/2004 | Hatakeyama et al. | |

FOREIGN PATENT DOCUMENTS

| | | | |
|---|---|---|---|
| DE | 4431517 | C1 | 2/1996 |
| EP | 1053799 | A2 | 11/2000 |
| EP | 1355080 | A1 | 10/2003 |
| EP | 1361006 | A1 | 11/2003 |
| JP | 2001-107725 | A | 4/2001 |
| JP | 2002-153930 | | 5/2002 |
| JP | 2002-192277 | | 7/2002 |
| JP | 2002-205128 | A | 7/2002 |
| JP | 2003-200241 | | 7/2003 |
| JP | 2005-342725 | | 12/2005 |

* cited by examiner

*Primary Examiner* — Debra Sullivan
(74) *Attorney, Agent, or Firm* — Rabin & Berdo, P.C.

(57) ABSTRACT

A closing machine includes left and right chuck spindles (20) for driving a work piece (9) to rotate, a chuck spindle moving device (30) which moves the respective chuck spindles (20) in a horizontal direction orthogonal to a rotary axis O20 thereof, and left and right slide stoppers (34) for restricting the movement of the chuck spindles (20). The work piece (9) is introduced into each chuck spindle (20), and the chuck spindle moving device (30) moves the respective chuck spindles (20) until the movement of the respective chuck spindles (20) is stopped by the respective slide stoppers (34). During a closing operation, the rotary axis O20 of the chuck spindle (20) and a rotary axis O4 of a die (4) are offset in the horizontal direction by an offset S.

7 Claims, 7 Drawing Sheets

CLOSING METHOD AND CLOSING MACHINE

TECHNICAL FIELD

This invention relates to an improvement in a closing method and a closing machine for closing an open end of a metal pipe material.

BACKGROUND ART

In a closing method, a work piece constituted by a metal pipe material is rotated, and while heating the work piece, a die is pressed against the work piece. As the work piece is gradually pressed by the die, the work piece undergoes plastic deformation.

A closing machine used to perform this closing operation comprises an outer diameter chuck that grips the outer peripheral surface of the work piece, and a chuck spindle that drives the outer diameter chuck to rotate together with the work piece. The closing machine closes the work piece by pressing the die, which rotates at an offset in relation to the rotating work piece, against the work piece.

This closing method and closing machine are disclosed in JP2002-153930A.

In this conventional closing machine, the rotary axis of the work piece and the rotary axis of the die are offset from each other in a vertical direction.

However, to modify the offset of the closing operation in this conventional closing machine, an offset adjustment mechanism for raising and lowering the heavy chuck spindle and so on must be provided, causing the structure of the closing machine to become complicated.

It is therefore an object of this invention to provide a closing method and a closing machine with which an offset can be modified easily.

DISCLOSURE OF THE INVENTION

This invention provides a closing method for closing an open end of a work piece rotating about an axis by pressing a die, which rotates at an offset to the work piece, against the work piece. The method comprises holding the work piece in a chuck spindle which drives the work piece to rotate, moving the chuck spindle in a horizontal direction orthogonal to a rotary axis thereof, stopping the movement of the chuck spindle by a slide stopper, and closing the work piece by pressing the rotating die against the rotating work piece, wherein during a closing operation, the rotary axis of the chuck spindle and a rotary axis of the die are offset in the horizontal direction.

This invention also provides a closing machine for closing an open end of a work piece rotating about an axis by pressing a die, which rotates at an offset to the work piece, against the work piece. The machine comprises a chuck spindle which drives the work piece to rotate, a chuck spindle moving device which moves the chuck spindle in a horizontal direction orthogonal to a rotary axis thereof, and a slide stopper which restricts the movement of the chuck spindle, wherein during a closing operation, the rotary axis of the chuck spindle and a rotary axis of the die are offset in the horizontal direction.

According to this invention, the slide stopper restricts the movement of the chuck spindle such that the chuck spindle is stopped in a predetermined closing operation position, and therefore the offset of the closing operation can be modified easily by altering the size of the slide stopper and so on. As a result, there is no need to provide an offset adjustment mechanism for raising and lowering the heavy chuck spindle to modify the offset of the closing operation, and therefore the structure of the closing machine can be simplified.

BEST MODE FOR CARRYING OUT THE INVENTION

This invention will now be described in further detail with reference to the attached drawings.

Figure 1:
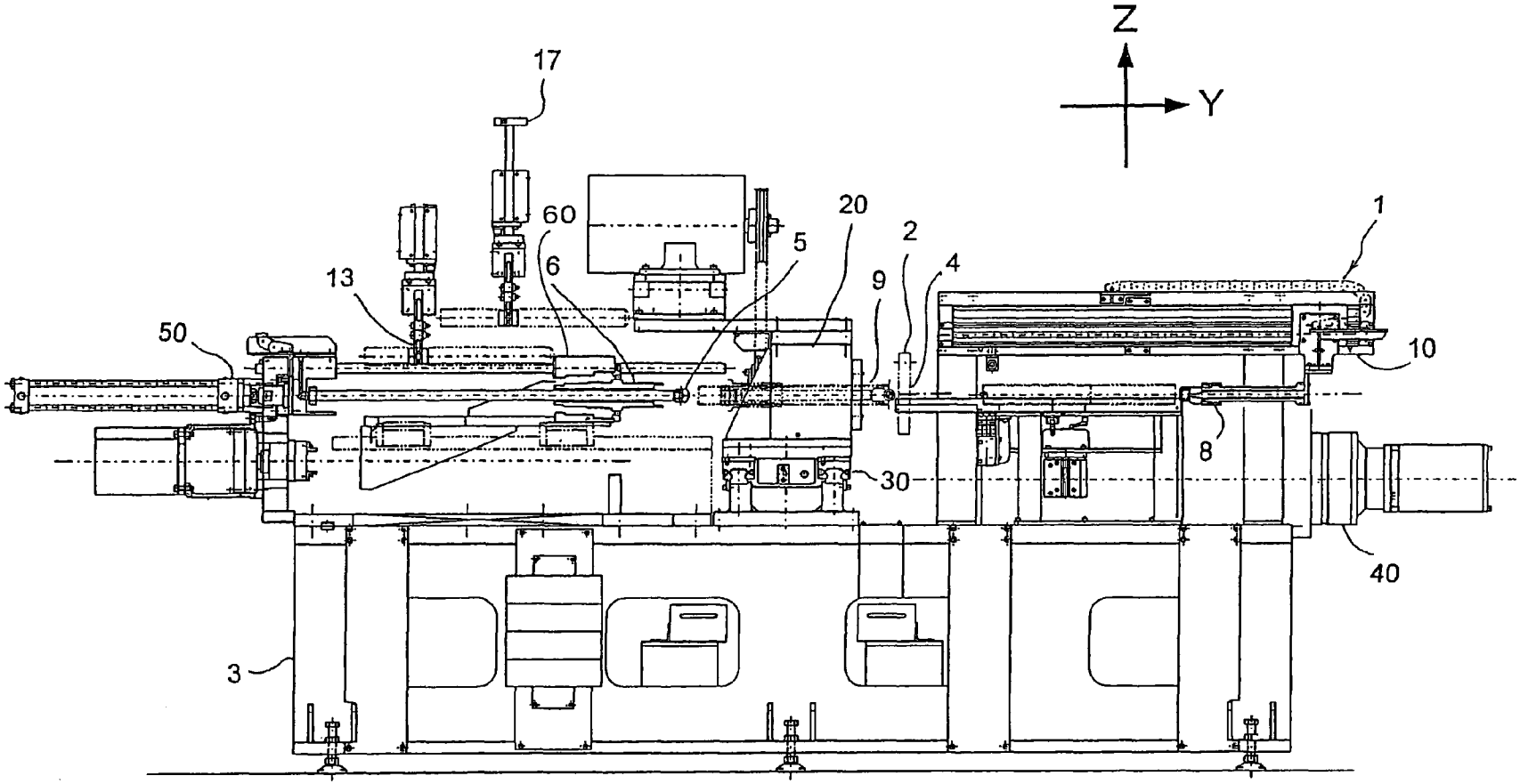
FIG. 1 is a side view of a closing machine, illustrating an embodiment of this invention.
Figure 2:
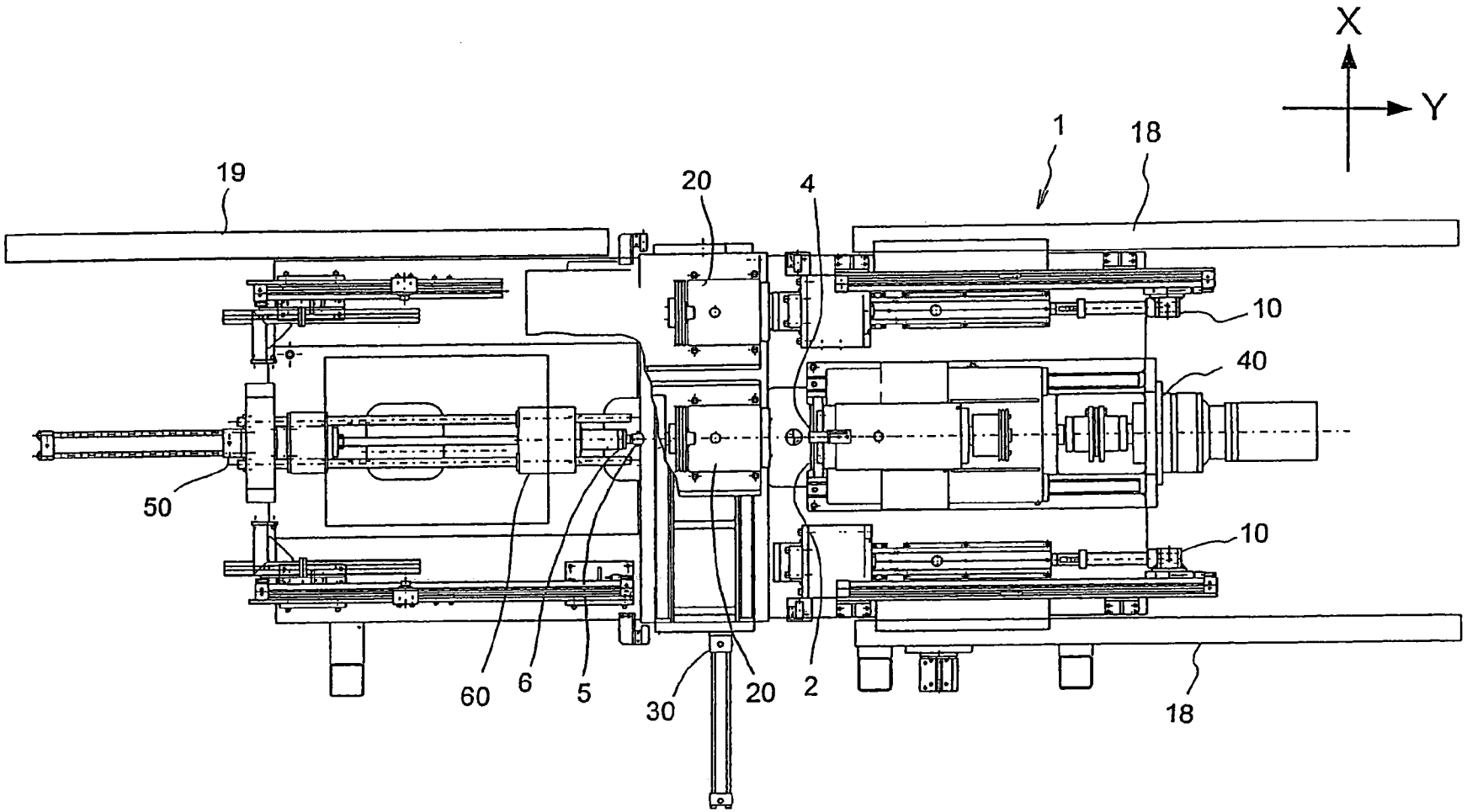
FIG. 2 is a plan view of the closing machine.
Figure 3:
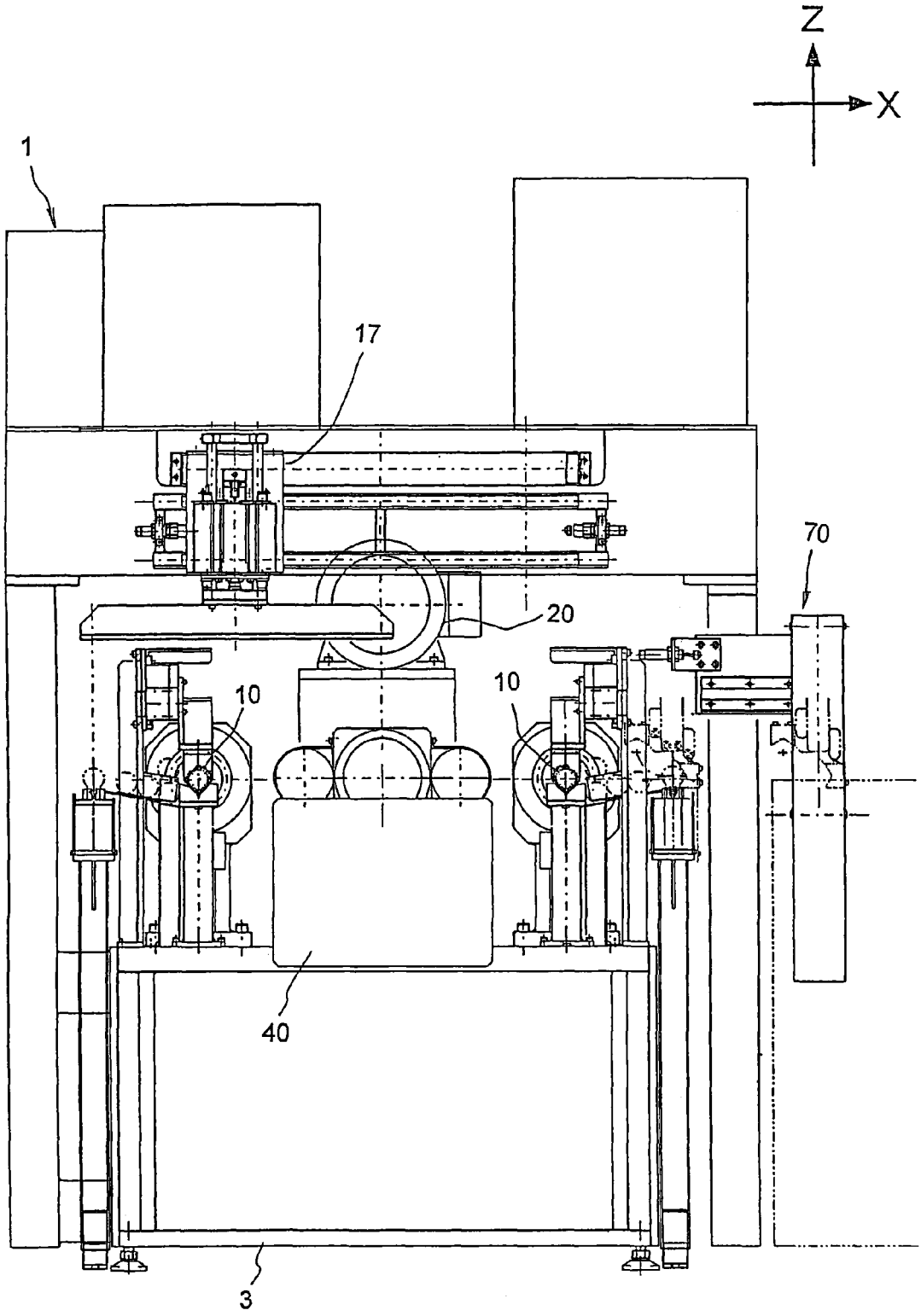
FIG. 3 is a front view of the closing machine.

FIGS. 1 to 3 show the overall constitution of a closing machine 1. In FIGS. 1 to 3, three axes, namely X, Y, and Z, are set orthogonal to each other. It is assumed that the X axis extends in a substantially horizontal lateral direction, the Y axis extends in a substantially horizontal front-rear direction, and the Z axis extends in a substantially vertical direction. The overall constitution of the closing machine 1 will now be described.

Two chuck spindles 20 which drive a work piece 9 to rotate about its axial center, and a single die driving device 40 which drives a die 4, are provided in a central portion of the closing machine 1. The chuck spindles 20 perform a reciprocating motion in the X axis direction relative to a pedestal 3 via a chuck spindle moving device 30, to be described later, thereby moving alternately to the central portion of the closing machine 1 so as to bring the work piece 9 face to face with the die 4.

The closing machine 1 performs a closing operation to close an open end of the work piece 9 by heating the work piece 9, which is constituted by a metal pipe material, using a high-frequency heating device 2, and pressing the die 4 against the rotating work piece 9 such that the work piece 9 undergoes plastic deformation.

A thrust stopper moving device 60, which is positioned in front of the chuck spindle 20 for closing the work piece 9 so as to support an end portion of the work piece 9, and a core moving device 50, which moves a core 5 inside the work piece 9, are provided in the central portion of the closing machine 1.

A pair of conveyors 18 and a work piece introducing device 10 are provided respectively on the left and right rear portions of the working machine 1. The work piece 9 is conveyed forward in the Y axis direction by each of the conveyors 18 and then conveyed forward in the Y axis direction by each of the work piece introducing devices 10, which are capable of movement in the Y axis direction. Thus, the work piece 9 is introduced into and gripped by the respective left and right chuck spindles 20.

While one of the chuck spindles 20 is positioned in the central portion of the working machine 1 during a closing operation, the other chuck spindle 20 is positioned on either the left or right end portion of the closing machine 1 so as to receive the work piece 9 conveyed by the respective work piece introducing devices 10.

A discharge device 17 for discharging the work piece 9 following the closing operation is provided above of the closing machine 1. The discharge device 17 causes a hand 13 gripping the work piece 9 to reciprocate in the X axis direction relative to the pedestal 3 such that the work piece 9, which is pushed out from the left and right chuck spindles 20, is conveyed to a conveyor 19 disposed on the right-hand front portion of the closing machine 1.

Once the closing operation is complete, the work piece 9, which is at a high temperature of 1000° C. or more, is conveyed to a cooling device 70 (see FIG. 3) by the conveyor 19 and cooled by the cooling device 70. The cooling device 70 is provided on the front right side of the closing machine 1 with respect to the direction of conveyance of the work piece 9.

FIGS. 4A to 4G show a series of processes performed by the closing machine 1 to close the work piece 9. Each process of this closing method will now be described in sequence.

Figure 4A:
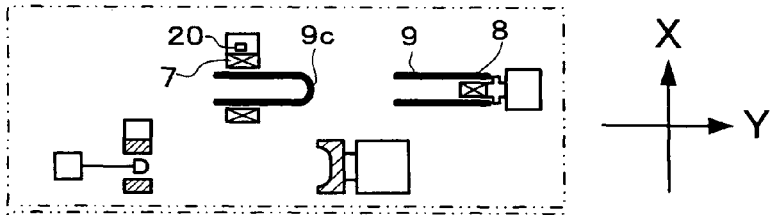
FIGS. 4A-4H are views showing closing processes.

Referring to FIG. 4A, an inner diameter chuck 8 of the work piece introducing device 10 is inserted into the work piece 9 such that the inner diameter chuck 8 grips the inner peripheral surface of the work piece 9.

Figure 4B:
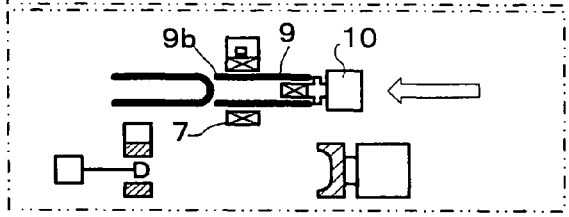

Referring to FIG. 4B, the work piece introducing device 10 causes the inner diameter chuck 8 to advance in the Y axis direction such that the work piece 9 is inserted into an outer diameter chuck 7 of the chuck spindle 20. Thus, the outer diameter chuck 7 grips the outer peripheral surface of the work piece 9.

Figure 4C:
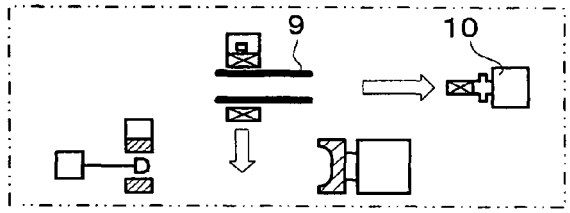

Referring to FIG. 4C, the work piece introducing device 10 causes the inner diameter chuck 8 to retreat in the Y axis direction such that the inner diameter chuck 8 is extracted from the work piece 9. Next, the chuck spindle moving device 30 moves the chuck spindle 20 in the X axis direction until the work piece 9 is stopped in an operation position facing the die 4.

Figure 4D:
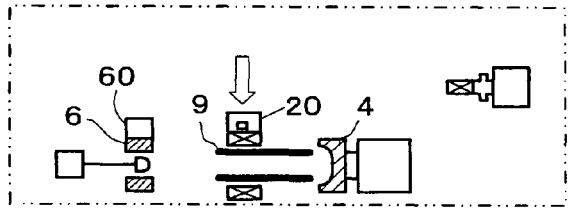

Referring to FIG. 4D, the thrust stopper moving device 60 moves a thrust stopper 6 to a thrust operation reference position supporting a base end portion 9*b* of the work piece 9.

Figure 4E:
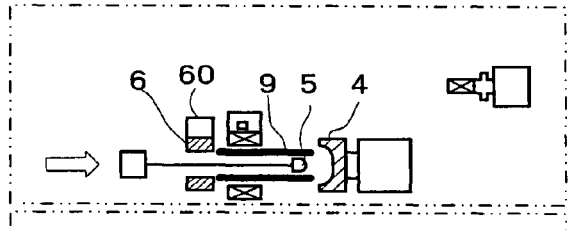

Referring to FIG. 4E, the core moving device 50 introduces the core 5 into the inside of the work piece 9.

Figure 4F:
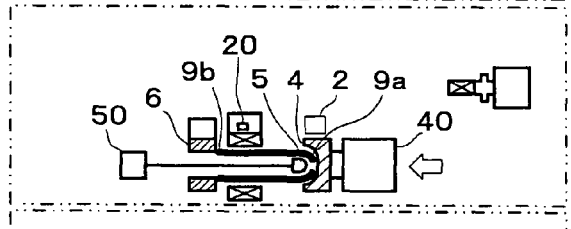

Referring to FIG. 4F, the chuck spindle 20 drives the work piece 9 and the core 5 to rotate. Meanwhile, the die 4 is pressed against the heated work piece 9 by the die driving device 40. Thus, a tip end portion 9*a* of the work piece 9 is steadily reduced in diameter between the die 4 and the core 5 such that finally, the tip end portion 9*a* of the work piece 9 closes to form a bottom portion 9*c*.

Figure 4G:
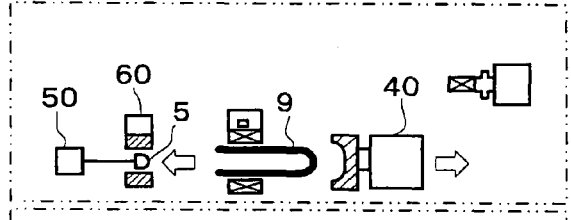

Referring to FIG. 4G, the die driving device 40 moves the die 4 rearward in the Y axis direction away from the work piece 9. Meanwhile, the thrust stopper moving device 60 moves the thrust stopper 6 forward in the Y axis direction away from the thrust operation reference position, and the core moving device 50 removes the core 5 from the inside of the work piece 9.

To close another work piece 9 thereafter, the chuck spindle moving device 30 moves the chuck spindle 20 in the X axis direction such that the work piece 9 faces the inner diameter chuck 8, as shown in FIG. 4A. Then, as shown in FIG. 4B, the work piece introducing device 10 causes the inner diameter chuck 8 to advance in the Y axis direction such that the base end portion 9*b* of the unclosed work piece 9 abuts against the bottom portion 9*c* of the closed work piece 9, and thus the closed work piece 9 is pushed out of the outer diameter chuck 7.

Figure 4H:
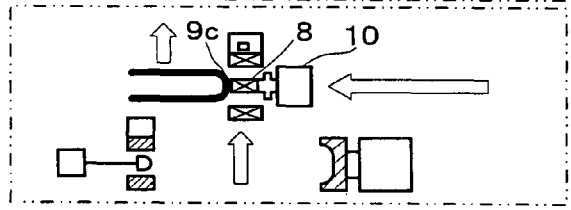

To terminate the closing operation of the work piece 9, the work piece introducing device 10 causes the inner diameter chuck 8 to advance in the Y axis direction, as shown in FIG. 4H, such that the inner diameter chuck 8 abuts against the bottom portion 9*c* of the closed work piece 9, and thus the closed work piece 9 is pushed out of the outer diameter chuck 7.

The overall constitution of the closing machine 1 was described above.

Figure 5:
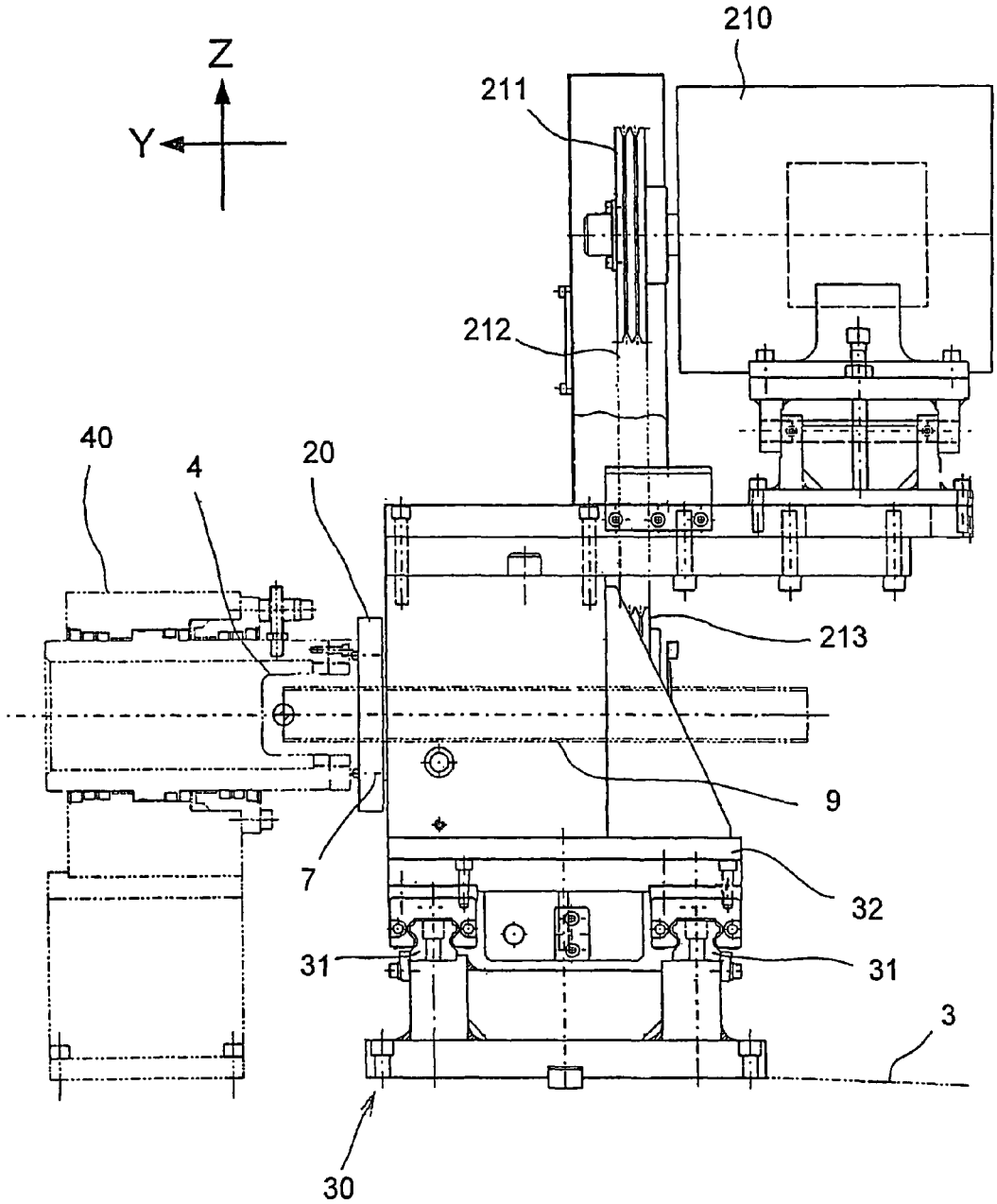
FIG. 5 is a side view of a chuck spindle moving device.

Next, the constitution of the chuck spindle moving device 30, shown in FIGS. 5 to 7, will be described.

The chuck spindle moving device 30 causes each chuck spindle 20 to reciprocate in a left-right direction relative to the pedestal 3 such that the chuck spindles 20 are alternately caused to face the respective inner diameter chucks 8 and the die 4.

The chuck spindle moving device 30 comprises sliding tables 32 respectively carrying the left and right chuck spindles 20, two guide rails 31 which support the sliding table 32 such that the sliding table 32 can move in a horizontal direction (the X axis direction) orthogonal to the rotary axis of the chuck spindle 20, a hydraulic cylinder 33 which moves the sliding table 32 along the guide rail 31, left and right slide stoppers 34 which restrict the movement of the sliding table 32, left and right dampers 35 which alleviate the impact generated when the respective sliding tables 32 are brought into contact with, and stopped by, the respective slide stoppers 34, and left and right sensors 36 which detect that the sliding tables 32 are in predetermined left and right positions.

The rotation of a motor 210 is transmitted to the outer diameter chuck 7 in the chuck spindle 20 via a pulley 211, a belt 212, and a pulley 213.

The left and right slide stoppers 34 are disposed substantially coaxially with the hydraulic cylinder 33.

The hydraulic cylinder 33 moves the respective chuck spindles 20 in the left-right direction in accordance with signals output from a controller, not shown in the figure, and stops them in an instructed position.

In this embodiment, a rotary axis O20 of the chuck spindle 20 and a rotary axis O4 of the die 4 are set at the same height. In other words, the offset between the rotary axis O20 of the chuck spindle 20 and the rotary axis O4 of the die 4 in the vertical direction is zero. It should be noted, however, that this invention is not limited thereto, and the rotary axis O20 of the chuck spindle 20 and the rotary axis O4 of the die 4 may be set at an offset in the vertical direction.

The closing method of this invention comprises a process for holding the work piece 9 in a chuck spindle 20, a process in which the chuck spindle moving device 30 moves the chuck spindle 20 to a closing operation position in which the work piece 9 faces the die 4, and a process for stopping the movement of the chuck spindle 20 using the respective slide stoppers 34. The rotary axis O20 of the chuck spindle 20 and the rotary axis O4 of the die 4 are set at an offset S in the horizontal direction.

Next, each process of the closing method described above will be described in sequence.

Figure 6:
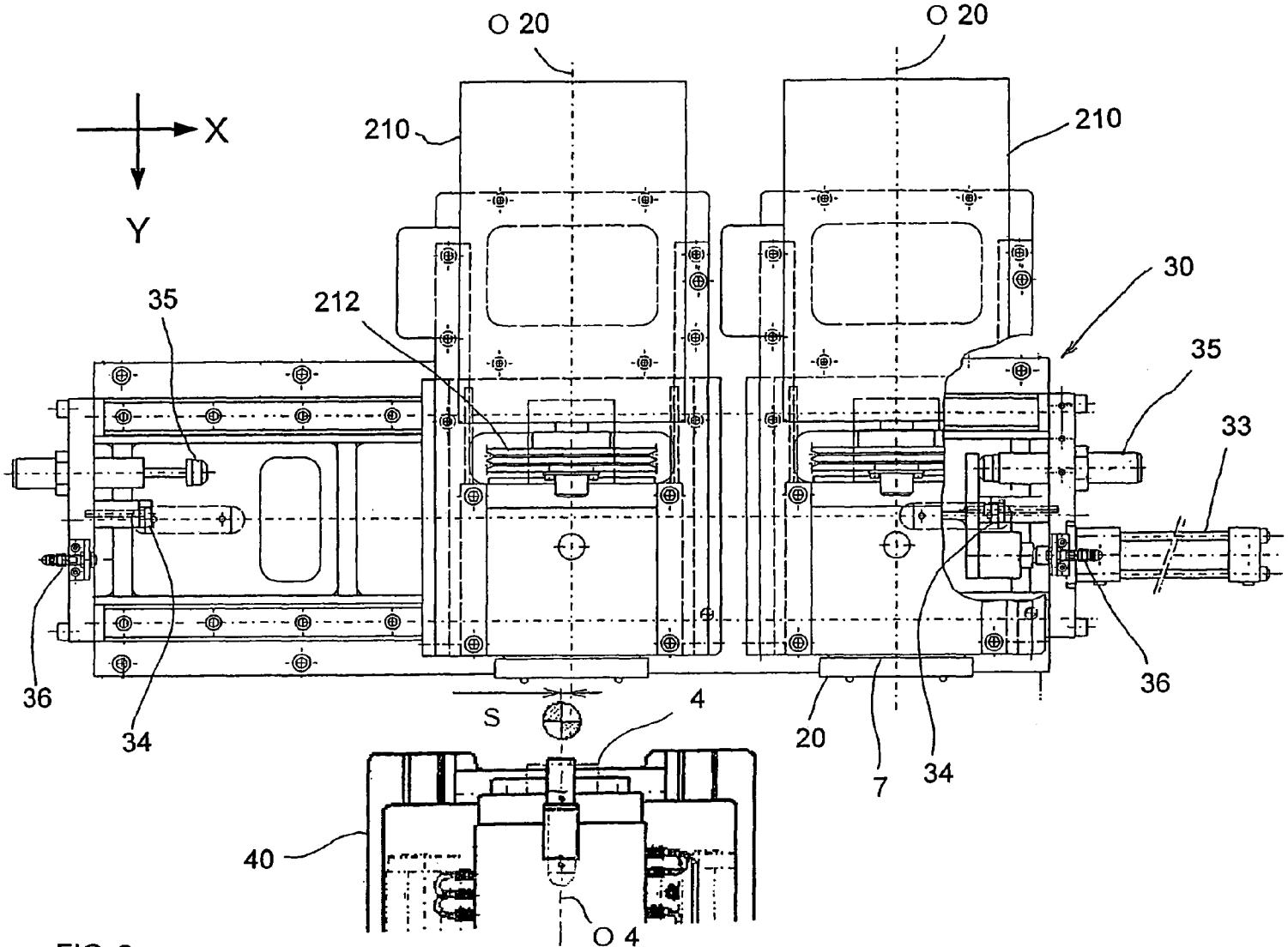
FIG. 6 is a plan view of the chuck spindle moving device.
Figure 7:
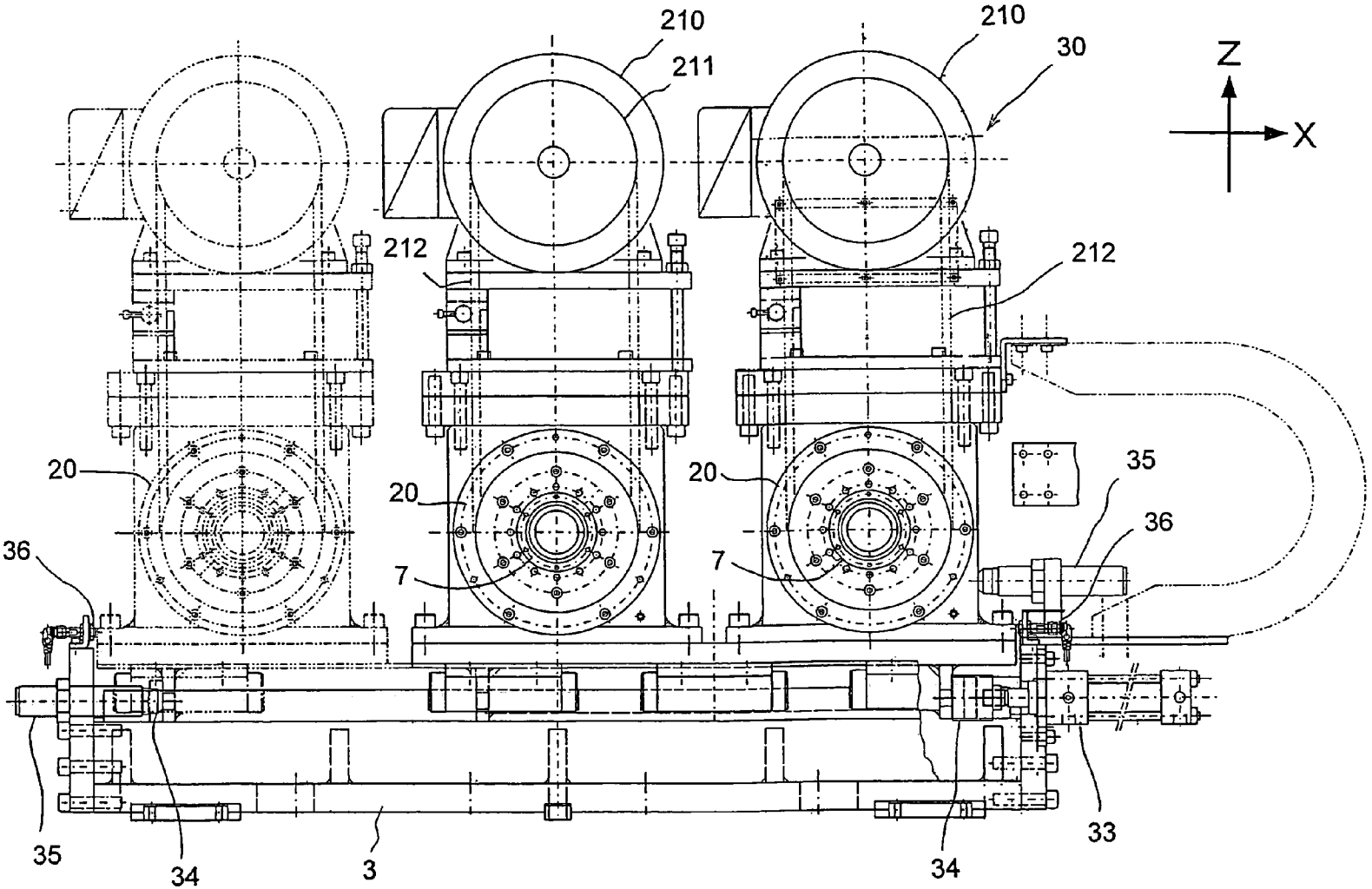
FIG. 7 is a front view of the chuck spindle moving device.

As shown by the solid lines in FIGS. 6 and 7, the hydraulic cylinder 33 contracts to bring the sliding table 32 into contact with the right-hand slide stopper 34. As a result, the left-hand chuck spindle 20 stops in a closing operation position that is offset from the die 4 by the offset S. Meanwhile, the right-hand chuck spindle 20 stops in an introduction position coaxial with the inner diameter chuck 8.

Next, the die 4 is pressed against the work piece 9 while rotating about an axis offset from the central axis of the work piece 9, which is rotated by the left-hand chuck spindle 20, by the predetermined offset S, and thus the work piece 9 is closed. At this time, the inner diameter chuck 8 introduces an unclosed work piece 9 into the right-hand chuck spindle 20, whereby a closed work piece 9 is pushed out of the right-hand chuck spindle 20.

Next, the hydraulic cylinder 33 expands to bring the sliding table 32 into contact with the left-hand slide stopper 34, as shown by the two-dot chain line in FIG. 7. As a result, the right-hand chuck spindle 20 stops in the closing operation position offset from the die 4 by the offset S. Meanwhile, the left-hand chuck spindle 20 stops in the introduction position coaxial with the left-hand inner diameter chuck 8.

Next, the die 4 is pressed against the work piece 9 while rotating about an axis offset from the central axis of the work piece 9, which is rotated by the right-hand chuck spindle 20, by the predetermined offset S, and thus the work piece 9 is closed. At this time, the inner diameter chuck 8 introduces an unclosed work piece 9 into the left-hand chuck spindle 20, whereby the closed work piece 9 is pushed out of the left-hand chuck spindle 20.

Thus, the closing machine 1 operates the left and right work piece introducing devices 10 and the left and right chuck spindles 20 alternately such that the conveyance operation and the closing operation of the work piece 9 are performed in parallel. In so doing, the tact time required for a single work piece 9 can be reduced to ten seconds or less, for example, enabling an improvement in productivity.

In this invention, the slide stoppers 34 restrict the movement of the chuck spindles 20 such that the chuck spindles 20 are stopped in a predetermined closing operation position, and therefore, the offset S of the chuck spindles 20 can be modified easily by replacing the slide stoppers 34 with different-sized slide stoppers 34 prepared in advance.

Further, the offset S may be modified automatically by providing an offset adjustment mechanism that varies the projection amount of the slide stopper 34.

Hence, there is no need to provide an offset adjustment mechanism for raising and lowering the heavy chuck spindles, as in the prior art, and as a result, the structure of the closing machine 1 can be simplified.

When the respective sliding tables 32 come into contact with, and are stopped by, the respective slide stoppers 34, the left and right dampers 35 contract to alleviate the impact on the chuck spindles 20. As a result, the movement speed of the chuck spindles 20 can be increased, enabling a reduction in tact time and an improvement in productivity.

INDUSTRIAL APPLICABILITY

The closing method and closing machine of this invention are not limited to a closing operation such as that described above, for closing an open end of a work piece, and may be used in a spinning operation to reduce the diameter of a work piece by pressing a die against the rotating work piece.

The invention claimed is:

1. A closing method for closing an open end of a work piece made of a pipe material by pressing a rotating die against the work piece rotating in a position which is offset from the die by a predetermined distance, comprising:

holding the work piece in a chuck spindle which drives the work piece to rotate;

moving the chuck spindle by a chuck spindle moving device in a horizontal direction orthogonal to a rotary axis of the chuck spindle;

stopping the movement of the chuck spindle by a slide stopper in a predetermined horizontal offset position which is horizontally offset to the die by the predetermined distance while alleviating an impact generated when the chuck spindle moving device abuts against the slide stopper by a damper, wherein the damper is separated and spaced apart from the slide stopper, and the chuck spindle moving device first comes in contact with the damper and then comes in contact with the slide stopper; and pressing the rotating die against the rotating work piece in the predetermined horizontal offset position, wherein the chuck spindle moving device is connected with the chuck spindle, such that the rotary axis of the chuck spindle is maintained parallel with an axis of the die while the chuck spindle is moved to the offset position.

2. The closing method as defined in claim 1, further comprising adjusting an offset distance between the rotary axis of the chuck spindle and the rotary axis of the die in the horizontal direction by adjusting a position of the slide stopper.

3. The closing method as defined in claim 1, wherein, when the chuck spindle is disposed in the predetermined horizontal offset position, the chuck spindle rotates the work piece.

4. A closing machine for closing an open end of a work piece made of a pipe material by pressing a rotating die against the work piece rotating in a position which is offset from the die by a predetermined distance, comprising:

a chuck spindle which drives the work piece to rotate;

a chuck spindle moving device which moves the chuck spindle in a horizontal direction orthogonal to a rotary axis thereof;

a slide stopper which stops the movement of the chuck spindle in a predetermined horizontal offset position which is horizontally offset to the die by the predetermined distance;

a damper which alleviates an impact generated when the chuck spindle moving device abuts against the slide stopper, wherein the damper is separated and spaced apart from the slide stopper, and the chuck spindle moving device first comes in contact with the damper and then comes in contact with the slide stopper; and a die driving device which presses the rotating die against the rotating work piece in the predetermined horizontal offset position, wherein the chuck spindle moving device is connected with the chuck spindle, such that the rotary axis of the chuck spindle is maintained parallel with an axis of the die while the chuck spindle is moved to the offset position.

5. The closing machine as defined in claim 4, wherein the slide stopper is configured to adjust an offset distance between the rotary axis of the chuck spindle and the rotary axis of the die in the horizontal direction by displacing horizontally.

6. The closing machine as defined in claim 4, wherein, when the chuck spindle is disposed in the predetermined horizontal offset position, the chuck spindle rotates the work piece.

7. A closing machine for closing an open end of a work piece made of a pipe material by pressing a rotating die against the work piece rotating in a position which is offset from the die by a predetermined distance, comprising:

a chuck spindle which drives the work piece to rotate;

a chuck spindle moving device which moves the chuck spindle in a horizontal direction orthogonal to a rotary axis thereof;

a slide stopper which stops the movement of the chuck spindle in a predetermined horizontal offset position which is horizontally offset to the die by the predetermined distance;

a die driving device which presses the rotating die against the rotating work piece in the predetermined horizontal offset position, and a second chuck spindle which is disposed in parallel with the first chuck spindle such that the first chuck spindle and the second chuck spindle are operated alternately.

* * * * *